US006234604B1

(12) United States Patent
Kawakami et al.

(10) Patent No.: US 6,234,604 B1
(45) Date of Patent: May 22, 2001

(54) INK JET RECORDING APPARATUS

(75) Inventors: Kazuhisa Kawakami; Nobutoshi Ohtsuka; Seiji Mochizuki; Shigenori Fukasawa; Takeo Seino; Kazunaga Suzuki; Masahiro Nakamura, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/961,806

(22) Filed: Oct. 31, 1997

(30) Foreign Application Priority Data

Oct. 31, 1996 (JP) ..... 8-305718
Oct. 3, 1997 (JP) ..... 9-287822

(51) Int. Cl.[7] ..... B41J 2/165
(52) U.S. Cl. ..... 347/23
(58) Field of Search ..... 347/23, 19, 29, 347/35

(56) References Cited

U.S. PATENT DOCUMENTS 4,207,578 * 6/1980 Marinoff ..... 347/25
4,970,527 * 11/1990 Gatten ..... 347/23
5,341,163 8/1994 Hanabusa ..... 347/23
5,572,242 * 11/1996 Fuji et al. ..... 347/23

FOREIGN PATENT DOCUMENTS 0 442 711 8/1991 (EP) ..... B41J/2/165
0 495 669 7/1992 (EP) ..... B41J/2/165
0 585 923 3/1994 (EP) ..... B41J/2/165
0 732 212 9/1996 (EP) ..... B41J/2/165
7-266578 10/1995 (JP) ..... B41J/2/175

* cited by examiner

*Primary Examiner*—John Barlow
*Assistant Examiner*—Charles W. Stewart, Jr.
(74) *Attorney, Agent, or Firm*—Sughrue, Mion, Zinn, Macpeak & Seas, PLLC

(57) ABSTRACT

An ink jet recording apparatus includes: a timer (26) that outputs a signal upon measurement of a predetermined time that is longer than a predetermined cycle during a period for which recording heads (8, 9) are released from a cap member (uncapped period) after a print command has been outputted; and a flushing control means (27) that control to move the recording heads (8, 9) to an ink receiving means so that the recording heads jet ink droplets, in response to the signal from the timer (26), and to reset the timer (26). If the predetermined time set to the timer (26) is up during uncapped period, the flushing control means (27) flushes a maximum number of ink droplets, and upon end of a single round of printing, the flushing control means (27) flushes a number of ink droplets corresponding to a time measured by the timer (26).

19 Claims, 7 Drawing Sheets

START
(a)
ARE RECORDING HEADS UNCAPPED?
NO
YES
(b)
START TIMER
(c)
HAS PREDETERMINED TIME ELAPSED?
YES
NO
(d)
SUSPEND PRINTING
(e)
FLUSH MAXIMUM NUMBER OF INK DROPLETS
(f)
RESET TIMER AND RESUME PRINTING
(g)
FLUSH NUMBER OF INK DROPLETS CORRESPONDING TO TIMER DATA AS OF PRINT END
(h)
RESET TIMER AND SEAL RECORDING HEADS
END

INK JET RECORDING APPARATUS

BACKGROUND OF THE INVENTION

1. Field of the Invention

This invention relates to an ink jet recording apparatus that prints patterns on a recording medium by jetting ink droplets out of nozzle openings.

2. Background

An ink jet recording apparatus employs a recording head that is designed to jet an ink droplet out of a nozzle opening by applying pressure to ink within a pressure producing chamber using a piezoelectric vibrator or a heating element. As a result of the use of the thus constructed recording head, the ink jet recording apparatus requires that some measures be taken to prevent impairment in printing quality attributable to the drying of ink and deposition of dust in the vicinity of the nozzle openings.

Although such ink jet recording head comes in a variety of structures as shown in FIGS. 7*a* to 7*c*, the ink jet recording head basically includes: pressure producing chambers 33, 34, 35 that receive pressure from pressure producing elements 30, 31, 32; and nozzle plates 40, 41, 42 having nozzle openings 37, 38, 39 formed therein, the nozzle openings 37, 38, 39 communicating with the pressure producing chambers 33, 34, 35 either directly or through a passage 36.

Furthermore, a recording head shown in FIG. 7*b* will now be described as an example. In the recording head, a meniscus 43 of ink formed adjacent to the nozzle opening 38 of the nozzle plate 41 is in contact with the atmosphere through an opening entrance 38*a* as shown in FIG. 8*a*. Therefore, if the nozzle opening 28 is left unused with no ink droplet jetted therefrom, an ink solvent present in a region adjacent to the nozzle opening volatilizes from the nozzle opening to thereby increase ink concentration adjacent to the nozzle opening as shown in FIG. 8*b*. Then, the highly concentrated region (the densely dotted region in FIG. 8*b*) is spread over the pressure producing chamber 34 as time elapses as shown in FIG. 8*c*, and the viscosity of the entire portion of the ink within the pressure producing chamber 34 comes to be thickened to such a degree as to make it impossible to jet ink droplets in the end.

When the ink concentration adjacent to the nozzle opening becomes so high in this way, the viscosity of ink increases. However, since a force derived from the pressure applied to the pressure producing chamber by the pressure producing means is constant, the quantity of ink of an ink droplet to be jetted out of the nozzle opening is decreased, which in turn brings about an extremely grave impairment of printing quality.

Performed as one of measures to overcome this problem is a flushing operation. That is, in a condition in which the recording head is released from the capping means such as during printing or during a period for waiting for an input of data, i.e., in a condition in which ink adjacent to the nozzle openings is not replenished and in which the ink solvent is easy to volatilize from the nozzle openings, the recording head is moved to the ink receiving member in the nonprinting region, and ink droplets are thereafter jetted out of the nozzle openings by applying a drive signal to the pressure producing means independently of printing data at a predetermined cycle, e.g., every 20 seconds, so that the viscosity-thickened ink adjacent to the nozzle openings is discharged.

After such flushing operation and a series of printing operations have been terminated, a flushing operation is performed immediately before the recording head is sealed with the capping device. That is, this flushing operation flushes a number of ink droplets greater than that to be jetted by the periodic flushing operation during a period for which the recording head is released from the capping device (hereinafter referred to as "uncapped period" whenever applicable), so that the recording head is sealed with the capping device after the viscosity-thickened ink present adjacent to the nozzle openings have been discharged reliably.

By the way, ink used for a recording head that is particularly dedicated to printing with a quality equivalent to photography by preventing the penetration of ink into a recording medium, has the ink solvent thereof evaporated at an extremely high speed and also has high film forming properties. In addition, if an ink having a viscosity of about 4 mpa·s, which is greater than that of a conventional ink, is to be used, the evaporation of the ink solvent at the nozzle openings even to a scanty degree brings about inconvenience in jetting ink droplets out of the nozzle openings.

For overcoming such problem, a technique shown in FIG. 9 is taken. That is, if the uncapped time is short, the number of ink droplets is increased in proportion to the total time for which the recording head has been released from the capping device, and when the total time exceeds a predetermined time, a flushing operation before capping is performed by jetting the number of ink droplets fixed to a maximum number.

However, in the ink having high film forming properties and having a viscosity of about 4 mpa·s that is higher than the conventional ink, the viscosity-increased ink region tends to spread deep into the recording head as shown in FIG. 8*c*. Therefore, if the uncapped period during a printing operation including a single round of printing is made longer, the aforementioned technique in which the ceiling is put on the number of ink droplets to be flushed during flushing is no longer viable to discharge the viscosity-thickened ink reliably.

Further, in order to discharge such viscosity-thickened ink that has been spread deep into the recording head reliably, the number of ink droplets to be flushed must be increased to an extremely large value. In such a case, the problem that the ink is wasted and that the capping means becomes large-sized if the capping means is designed to serve also as a waste ink tank and further as an ink receiving member.

The invention has been made in view of the aforementioned problems. The object of the invention is, therefore, to provide an ink jet recording apparatus that can discharge viscosity-thickened ink within the recording head reliably by suppressing the quantity of ink to be consumed for flushing operation before capping.

SUMMARY OF THE INVENTION

To overcome the aforementioned problems, the invention is applied to an ink jet recording head that includes: a recording head that is mounted on a carriage and that jets an ink droplet out of a nozzle opening, the carriage shuttling across the width of a recording medium; an ink receiving means that is arranged in a nonprinting region for receiving ink droplets jetted for a periodic flushing operation to be performed at a predetermined cycle during a cap releasing period in order to maintain ink jetting performance of the recording head during a printing operation; a cap member that seals the recording head; a timer that outputs a signal upon measurement of a predetermined time that is longer than the predetermined cycle during a period for which the recording head is released from the cap member after a print command has been outputted; and a flushing control means that jets ink droplets by moving the recording head to the ink receiving means in response to the signal from the timer and resetting the timer.

In addition to a periodic flushing operation performed at a predetermined cycle during uncapped period, a flushing operation is performed based on time measurement made by a timer during uncapped period, so that the viscosity-thickened ink present in a region from which the viscosity-thickened ink cannot be discharged by periodic flushing is discharged periodically at a stage where the thickening of viscosity is not so serious.

Accordingly, compared with the case where a flushing operation is performed after the viscosity-thickened ink region has spread deep into the pressure producing chambers, the thickening of viscosity can be prevented by discharging a far smaller quantity of ink.

DETAILED DESCRIPTION OF THE PREFERRED EMBODIMENTS

Figure 1:
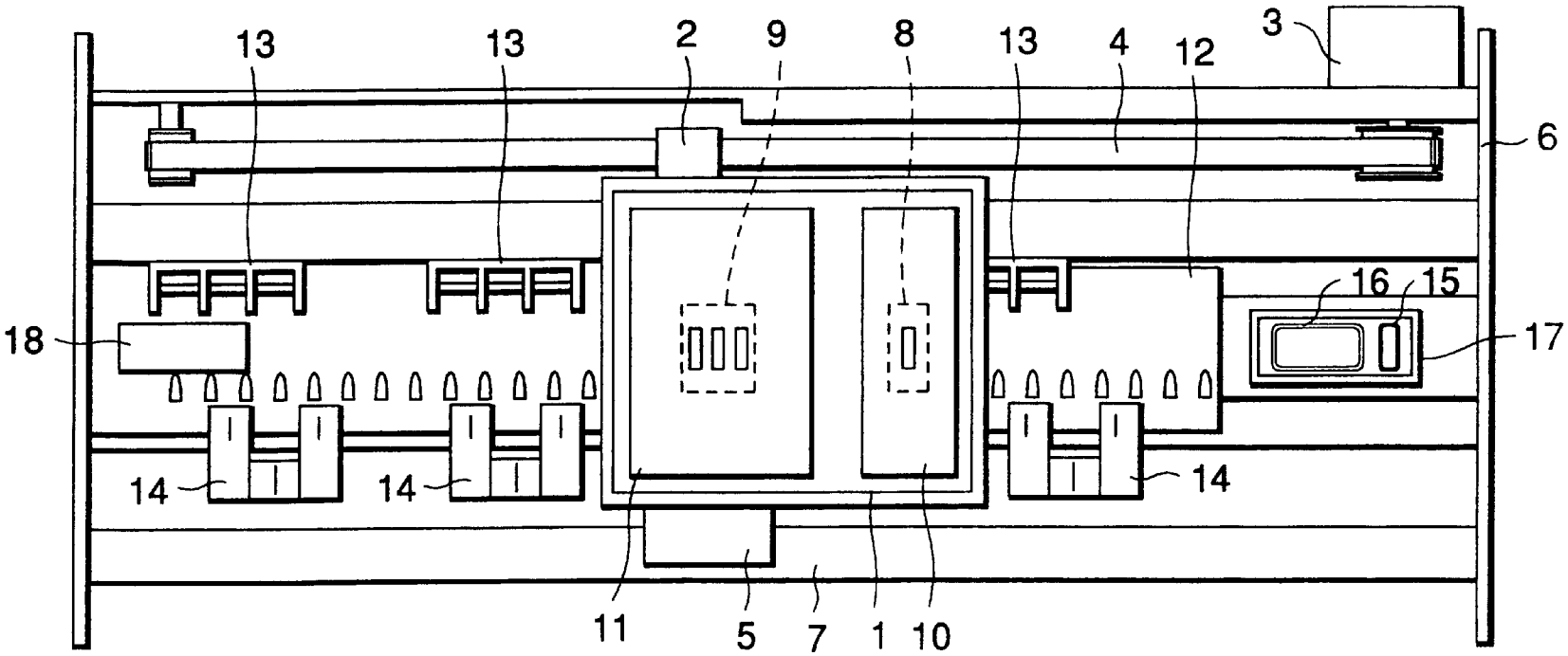
FIG. 1 is a diagram showing an ink jet recording apparatus, which is a first embodiment of the invention.

Details of the invention will now be described with reference to the embodiments shown in the drawings.

FIG. 1 is a top view showing an ink jet recording apparatus, which is an embodiment of the invention. In FIG. 1, reference numeral 1 denotes a carriage. One end of the carriage 1 is connected to a timing belt 4 through a coupling member 2 and the other end is supported by a guide member 7 of a housing 6 by a sliding piece 5, the timing belt 4 being connected to a motor 3. The carriage 1 can shuttle across the width of a recording sheet.

A recording head 8 for jetting black ink and a recording head 9 for jetting color inks are disposed on a carriage 1 surface confronting the recording sheet. A black ink cartridge 10 and a color ink cartridge 11 containing yellow, cyan, and magenta inks are releasably mounted on the top surface of the carriage 1.

Reference numeral 12 denotes a platen, which is large enough to cover a printing region and has sheet feed rollers 13 disposed toward the back thereof (the upper side as viewed in FIG. 1) and sheet discharge rollers 14 toward the front thereof (the lower side as viewed in FIG. 1). The sheet feed rollers 13 feed the recording sheet from a not shown sheet feed cassette to a printing region, and the sheet discharge rollers 14 guide the recording sheet to a printing end region.

A capping device 17 that has cap members 15, 16 for sealing the respective recording heads 8, 9 is arranged in a nonprinting region. These cap members 15, 16 serve also as an ink receiving member during flushing. Further, in this embodiment, a second ink receiving member 18 for receiving flushing ink droplets is arranged also in a nonprinting region on the other side.

Figure 2:
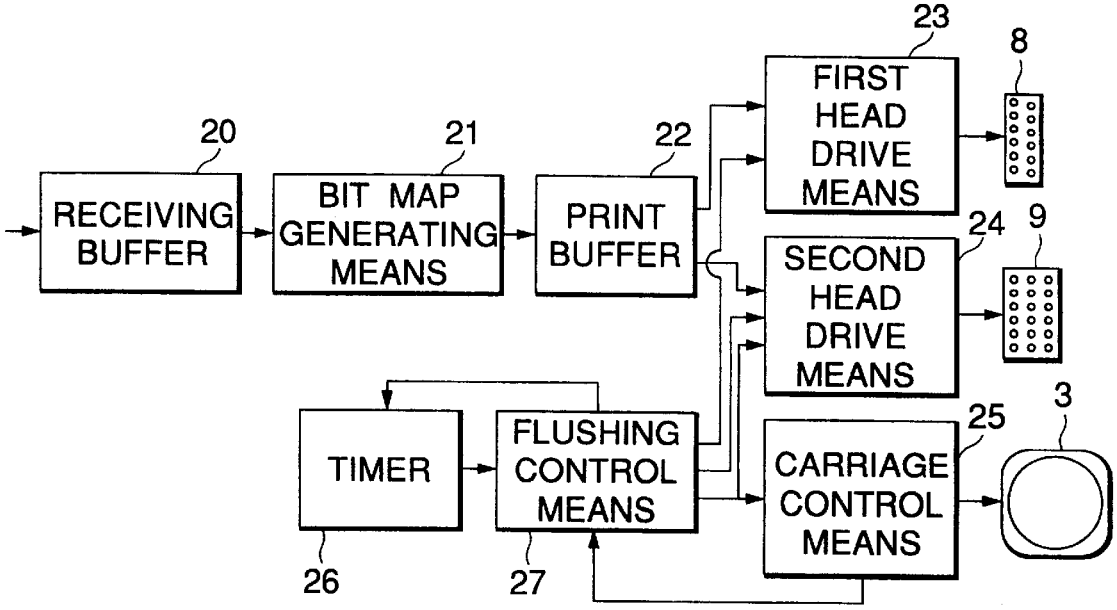
FIG. 2 is a block diagram showing the first embodiment of the invention.

FIG. 2 shows a drive device for controlling the aforementioned printing mechanism, the drive device being an embodiment of the invention. In FIG. 2, reference numerals 20, 21, 22 denote a receiving buffer for receiving print data from a not shown host, a bit map generating means for converting the print data into bit map data, and a print buffer, respectively, and reference numerals 23, 24 denote a first head drive means and a second head drive means that jet ink droplets from the recording heads 8, 9 in response to signals from the print buffer 22, and jet ink droplets out of all the nozzle openings of the recording heads 8, 9 during flushing operation to be described later.

A carriage control means 25 controls the carriage 1 in such a manner that the recording heads 8, 9 are caused to scan by driving the carriage 1 during printing, and that the recording heads 8, 9 move to the location confronting either the cap members 15, 16, which are the first ink receiving member, or the second ink receiving member 18.

A timer 26 measures the time for which the recording heads 8, 9 have been released from the capping device 17 upon output of a print command, and outputs a signal and then resets upon elapse of a predetermined time, e.g., 30 minutes, and further resets again upon end of a series of printing operations.

A flushing control means 27 has several functions. One is to perform a flushing operation, which is designed to jet ink droplets by moving the recording heads 8, 9 to the capping device 17 or to the ink receiving member 18 at a short cycle, e.g., at a cycle of 20 seconds, for a period during which the recording heads are released from the capping device 17 (hereinafter referred to as "uncapped period" whenever applicable) such as during printing. (This flushing operation will hereinafter be referred to as "periodic flushing operation during uncapped period").

Other functions to be performed by the flushing control means 27 are as follows. The flushing control means 27 activates the timer 26 by detecting the releasing of the recording heads 8, 9 from the capping device 17 in response to a signal from the carriage control means 25 or the like, and resets the timer 26 when the timer 26 has outputted a signal. When the signal has been received from the timer 26, the flushing control means 27 moves the recording heads 8, 9 to the capping members 15, 16 or to the ink receiving member 18 and thereafter jets ink amounting to a maximum number of flushes shown in FIG. 4, e.g., 20,000 ink droplets, independently of the time measured by the timer 26. Accordingly, a viscosity-thickened ink portion present in the pressure producing chambers as of the moment at which a region occupied by the ink portion whose viscosity has been thickened during the uncapped period has not spread far into the depth of the pressure producing chambers can be discharged.

If the recording heads 8, 9 are to be sealed by the capping device 17 as a printing operation has been terminated before the timer 26 is reset, the flushing control means 27 jets ink droplets with the number of flushes corresponding to the time measured by the timer 26. Accordingly, only such ink whose viscosity has been thickened can be discharged reliably while minimizing wasteful discharge of ink whose viscosity has not been thickened.

Figure 3:
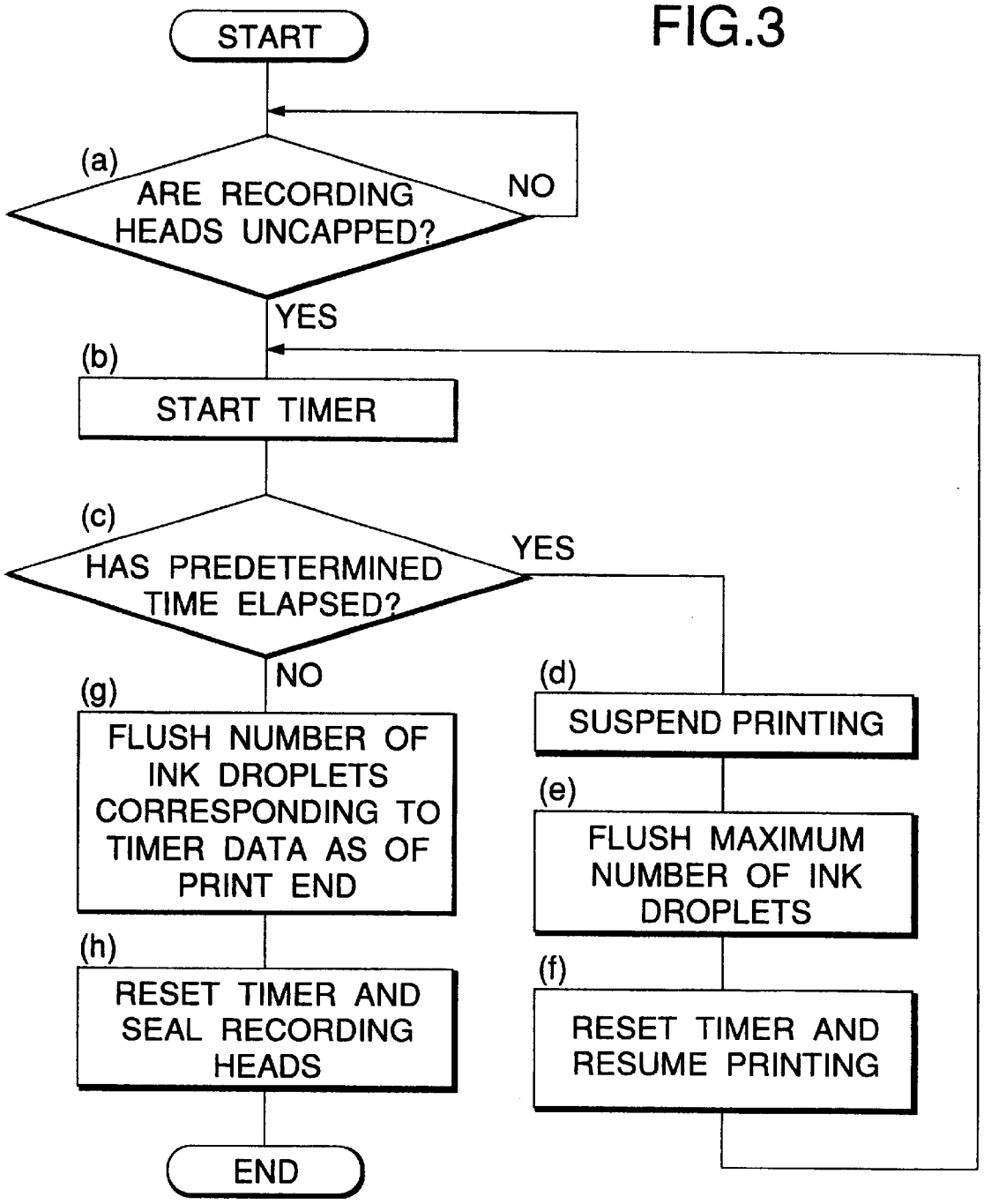
FIG. 3 is a flowchart showing the operation of the aforementioned apparatus.

The operation of the thus constructed apparatus will now be described based on the flowchart shown in FIG. 3.

When the recording head 8, 9 have been released from the capping device 17 upon input of a print command from a host (Step a), the flushing control means 27 activates the timer 26 (Step b).

Every time a predetermined time, e.g., 20 seconds or so elapses, after a printing operation has been started, the flushing control means 27 suspends the printing operation, moves the recording heads 8, 9 to the capping device 17 or to the ink receiving member 18, and carries out a periodic flushing operation during uncapped period by jetting, e.g., 30 or so ink droplets in order to prevent the clogging of the recording heads during printing.

Figure 4:
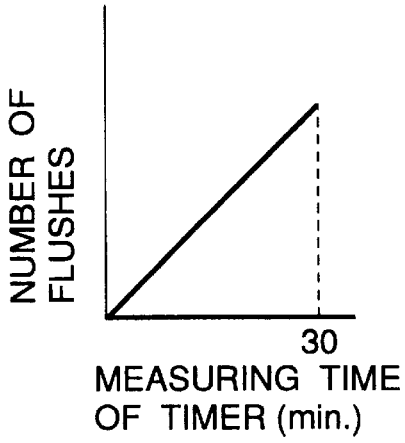
FIG. 4 is a diagram showing a mode of jetting ink droplets in the aforementioned apparatus.

When the time set to the timer 26 has elapsed while the printing operation is being continued with such periodic flushing operations during printing interrupting the printing operation (Step c), the flushing control means 27 suspends the printing operation (Step d), moves the recording heads 8, 9 to the capping device 17 or to the ink receiving member 18, and flushes, unlike periodic flushing during uncapped period, the maximum number of ink droplets set as the number of flushes to be made when the time set to the timer 26 has been up, the maximum number of ink droplets being, e.g., 20,000 or so ink droplets (Step e) as is indicated by the ink droplet data shown in FIG. 4.

As a result of this flushing operation, even the ink portion whose viscosity is relatively high because viscosity thickening has progressed relatively deep into the recording heads 8, 9 and which, therefore, cannot be discharged by periodic flushing during uncapped period can be discharged at an early stage, so that satisfactory printing quality can thereafter be provided reliably only by discharging a small quantity of ink consumed by periodic flushing to be performed during uncapped period. That is, once viscosity thickening has spread deep into the pressure producing chambers, the ink is unfortunately diffused over a wider range due to the expansion and contraction of the pressure producing chambers for jetting ink droplets. On the other hand, as long as ink is stagnant adjacent to the nozzle openings, such ink can be discharged intensively. Accordingly, the ink portion whose viscosity has been thickened can be discharged with a smaller quantity of ink.

Then, the flushing control means 27 resets and reactivates the timer 26, and thereafter resumes the printing operation while interrupting the printing operation with periodic flushing operations during uncapped period (Step f).

Then, every time the duration of a printing operation that is performed while allowing periodic flushing operations during uncapped period to interrupt such printing operation exceeds 30 minutes and every time the duration for which the recording heads 8, 9 have been released from the capping device 17 exceeds 30 minutes, the flushing control means 27 repeats the operation of flushing the maximum number of ink droplets, which is the number of flushes to be made when the time set to the timer 26 is up (Step e) and resetting and reactivating the timer 26 to thereby resume the printing operation (Step f).

If the printing operation is terminated before the time set to the timer is up (Step c), the flushing control means 27 flushes a number of ink droplets equivalent to a predetermined number of flushes that increases with the time measured by the timer 26 (Step g), and then moves the recording heads 8, 9 to the capping device 17 to be sealed by the capping device after resetting the timer 26 (Step h).

That is, if the printing time is shorter than the time set to the timer 26, the flushing control means 27 flushes a number of ink droplets corresponding to the time measured by the timer 26 only once upon end of the printing operation, and seals the recording heads with the capping device 17 upon end of the flushing operation. The flushing control means 27 then waits for the next printing operation.

As a result of such operation, the viscosity-thickened ink can be discharged out of the recording heads 8, 9 reliably with a quantity of ink corresponding to the degree of viscosity that has been thickened in accordance with the time period for which the recording heads have been left uncapped. Hence, wasteful consumption of ink can be checked.

It may be noted that the number of flushes to be made when the time set to the timer 26 is up and the time set to the timer 26 are experimentally calculated in accordance with the types of ink used for the recording heads 8, 9 and, therefore, set to optimal values.

Figure 5:
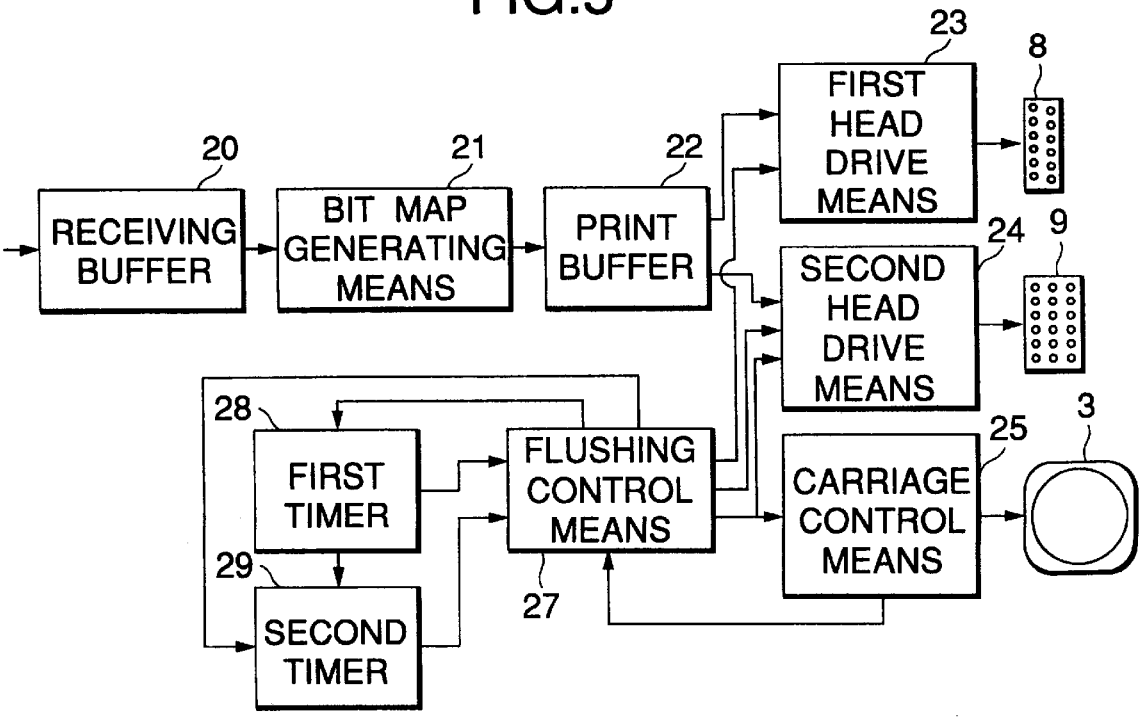
FIG. 5 is a block diagram showing another embodiment of the invention.

FIG. 5 shows another embodiment of the invention. In FIG. 5, reference numeral 28 denotes a first timer that has the function equivalent of the timer 26 in the aforementioned embodiment. That is, the timer 28 measures the time for which the recording heads 8, 9 have been released from the capping device 17 upon output of a print command, and outputs a signal and then resets upon elapse of a predetermined time, e.g., 30 minutes, and further resets again upon end of a single round of printing.

Reference numeral 29 denotes a second timer, which starts measuring time when the recording apparatus gets operable with the power supply turned on or upon releasing the recording heads from the capping device 17 for the first time, measures the total time for which the recording apparatus is in operation, outputs a signal upon elapse of a time that is longer than the time set to the first timer 28, e.g., 60 minutes, and then resets.

Figure 6:
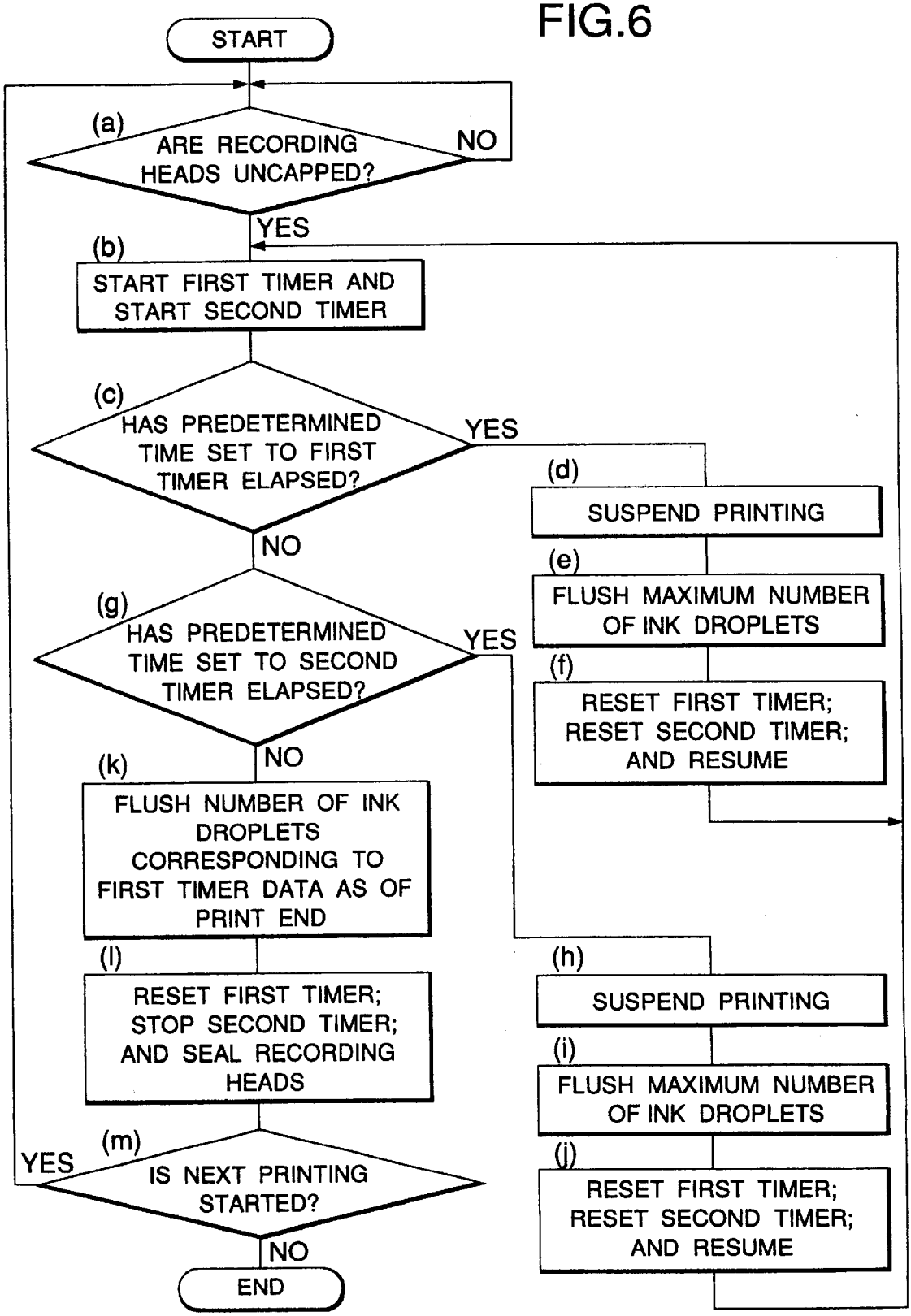
FIG. 6. is a flowchart showing another embodiment of the invention.
Figure 7A:
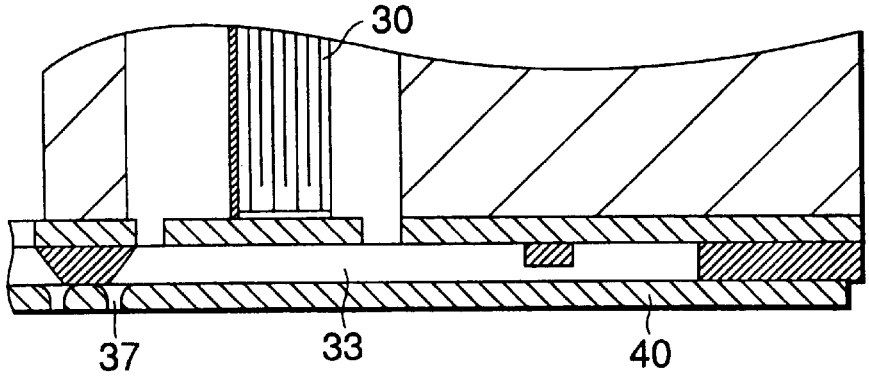
FIGS. 7*a* to 7*c* are sectional views respectively showing exemplary ink jet recording apparatuses.
Figure 7B:
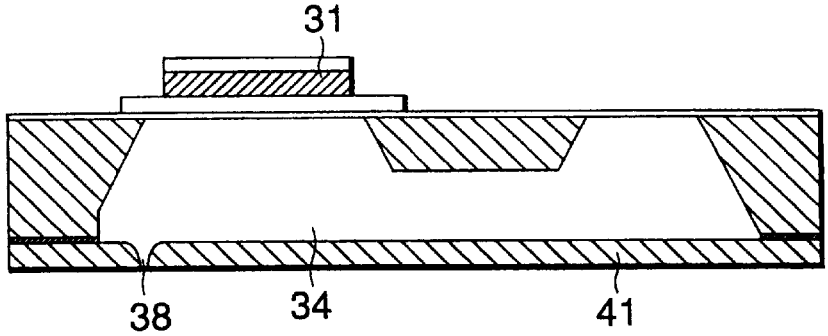
Figure 7C:
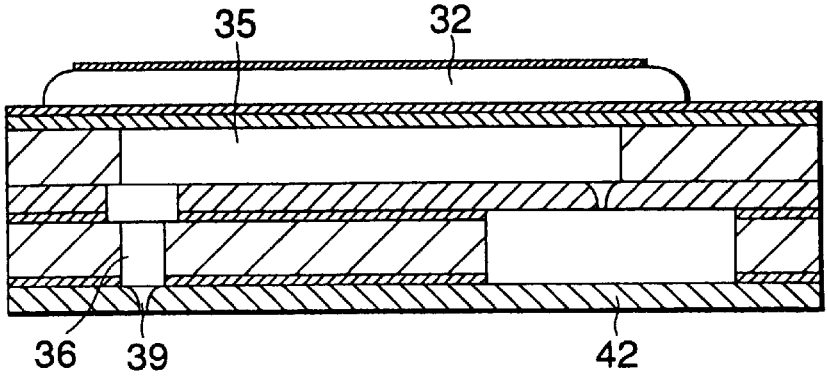

Then, the operation of the thus constructed embodiment will be described based on the flowchart shown in FIG. 6.

When the recording heads 8, 9 are released in response to a print command from a host (Step a), the first timer 28 and the second timer 29 start measuring time, respectively (Step b).

Every time a predetermined time, e.g., 20 seconds or so elapses after a printing operation has been started, the flushing control means 27 suspends the printing operation, moves the recording heads 8, 9 to the capping device 17 or to the ink receiving member 18, and carries out a periodic flushing operation during uncapped period in order to prevent the clogging of the recording heads during printing.

When the first timer 28 has measured a predetermined time, i.e., 30 minutes in this embodiment while the printing operation is being continued with such periodic flushing operations during printing interrupting the printing operation (Step c), the flushing control means 27 suspends the printing operation (Step d), and moves the recording heads 8, 9 to the capping device 17 or to the ink receiving member 18.

Then, the flushing control means 27 flushes the maximum number of ink droplets, which is the number of flushes to be made when the time set to the timer is up as indicated in the ink droplet data shown in FIG. 4 (Step e). After the flushing operation has been terminated, both the first timer 28 and the second timer 29 are reset and reactivated, so that the printing operation is resumed allowing periodic flushing operations during uncapped period to interrupt the printing operation (Step f).

Then, every time the duration of a printing operation that is performed while allowing periodic flushing operations during uncapped period to interrupt such printing operation exceeds 30 minutes and every time the duration for which the recording heads 8, 9 have been released from the capping device 17 exceeds 30 minutes, the flushing control means 27 repeats the operation of suspending the printing operation (Step d), flushing the maximum number of ink droplets, which is the number of flushes to be made when the times set to the first timer 28 and the second timer 29 are up (Step e), and resetting and reactivating the first timer 28 and the second timer 29 to thereby resume the printing operation (Step f).

Figure 8A:
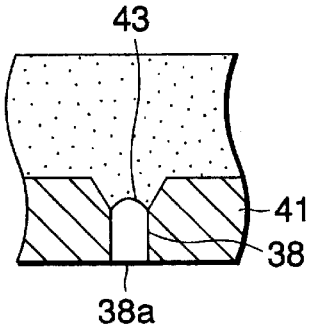
FIGS. 8*a* to 8*c* are diagrams respectively showing a process in which the viscosity of ink adjacent to a nozzle opening is being thickened.
Figure 8B:
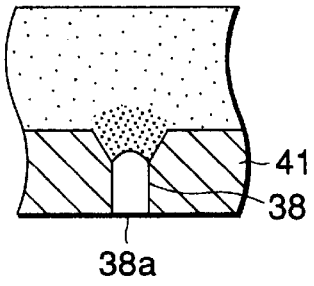
Figure 8C:
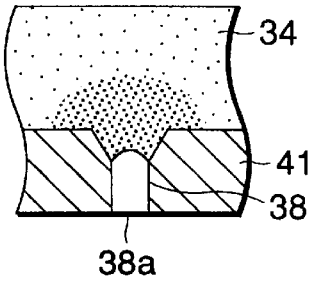
Figure 9:
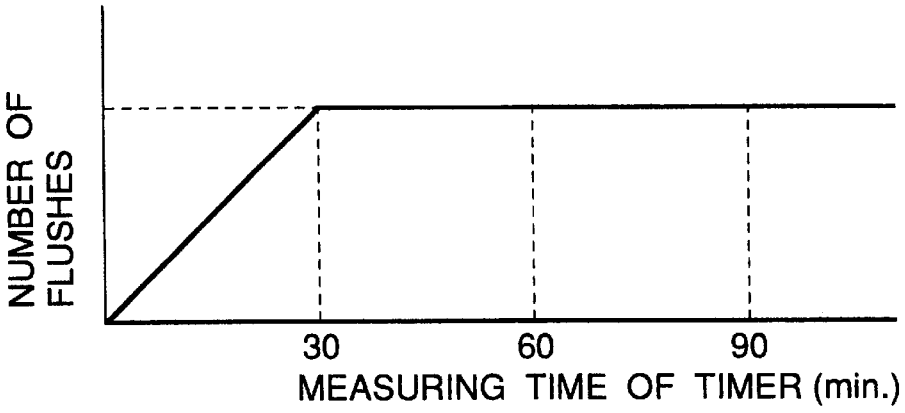
FIG. 9 is a diagram showing an exemplary mode of jetting ink droplets during flushing in a conventional ink jet recording apparatus.

Accordingly, an ink portion that is highly viscous due to the thickening of viscosity having been spread slightly toward the pressure producing chambers from the nozzle openings so that such ink portion cannot be discharged by periodic flushing during uncapped period that involves a small number of flushes (FIG. 8*c*) is discharged at an early stage. Accordingly, the highly viscous ink portion can be discharged reliably with a smaller quantity of ink than in the case where a viscosity-thickened ink portion is to be discharged after the viscosity-thickened ink region has been spread with the thickening of viscosity having progressed deeper into the pressure producing chambers. Hence, the ink jetting performance of the recording heads 8, 9 can be maintained over a long period of time, which in turn contributes to reliably providing satisfactory printing quality thereafter by only discharging a small quantity of ink used in periodic flushing to be performed during uncapped period.

When a single round of printing has been terminated, the flushing control means 27 flushes ink droplets required for the predetermined number of flushes that is increased with the time measured by the first timer 28 (Step k), and resets the first timer 28 on the one hand, and temporarily stops the time measuring operation of the second timer 29 without resetting the second timer 29 on the other hand, and thereafter moves the recording heads 8, 9 to the capping device 17 to be sealed (Step 1).

As a result of such operation, the viscosity-thickened ink can be discharged out of the recording heads 8, 9 reliably with a quantity of ink corresponding to the degree of viscosity that has been thickened in accordance with the time period for which the recording heads have been left uncapped. Hence, wasteful consumption of ink can be checked.

When a next print command has been received after having capped the recording heads (Step m), the recording heads 7, 8 are released from the capping device 17 (Step a), and not only the first timer 28 is newly activated, but also the second timer 29 whose time measuring operation has been temporarily stopped is caused to resume the operation (Step b), and the aforementioned steps are repeated.

Thus, every time the printing operation is resumed, the first timer 28 is newly started, and the second timer 29 is continuously operated for measuring time. When a printing operation is repeated for a plurality of times during a shorter period than the time set to the first timer 28 and when the accumulated time for which the recording heads 7, 8 have been released from the capping device 17, although intermittently, exceeds the time set to the second timer 29, e.g., 60 minutes (Step g), a signal is outputted from the second timer 29.

The flushing control means 27 suspends the printing operation (Step h), moves the recording heads 8, 9 to the capping device 17 or to the ink receiving member 18, and flushes preferably the number of ink droplets equal to the maximum number of flushes to be made when the time set to the first timer 28 is up (Step i). After the flushing operation, both the first timer 28 and the second time 29 are reset and both the timers 28, 29 are reactivated to thereby resume printing.

By performing a flushing operation while causing the second timer 29 to take into account also the accumulated time for which the recording heads 8, 9 have been uncapped in this way, a viscosity-thickened ink portion present more toward the pressure producing chambers than at the nozzle openings, which cannot be discharged through a number of flushing operations repeated at the time of printing a small volume of data, can be discharged reliably.

While the ink receiving member 18 is arranged separately from the cap members in the aforementioned embodiments, it is apparent that similar operation can be performed when the cap members 15, 16 are used as the ink receiving member.

Further, while the start timing of a flushing operation to be performed at a longer cycle is controlled by the first timer 28 and the second timer 29 in the aforementioned embodiment, it is apparent that similar operation can be performed by counting a signal from other time measuring means, e.g., a third timer for causing flushing operation to be performed at such a short cycle as ten to several tens of seconds or so while the recording heads 8, 9 are being released from the cap members, and by utilizing such count for controlling the start timing of a flushing operation to be performed at the longer cycle.

As described in the foregoing, the ink jet recording head of the invention includes: a recording head that is mounted on a carriage and that jets an ink droplet out of a nozzle opening, the carriage shuttling across the width of a recording medium; an ink receiving means that is arranged in a nonprinting region for receiving ink droplets jetted for a periodic flushing operation to be performed at a predetermined cycle during a cap releasing period in order to maintain ink jetting performance of the recording head during a printing operation; a cap member that seals the recording head; a timer that outputs a signal upon measurement of a predetermined time longer than the predetermined cycle during a period for which the recording head is released from the cap member after a print command has been outputted; and a flushing control means that jets ink droplets by moving the recording head to the ink receiving means in response to the signal from the timer and resetting the timer. Therefore, in addition to a periodic flushing operation performed at a predetermined cycle during uncapped period, a flushing operation is performed based on time measurement made by a timer during uncapped period, so that the viscosity-thickened ink in a region which cannot be discharged by periodic flushing is discharged periodically at a stage where the thickening of viscosity is not so serious. As a result, the viscosity-thickened ink can be discharged with a far smaller quantity of ink than that required for discharging the viscosity-thickened ink in the region to which the thickening of viscosity has progressed quite seriously such as before capping the recording heads. Furthermore, such discharging of ink is not wasted, which is an advantage. That is, such flushing operation can be utilized effectively in the sense that satisfactory ink jetting performance can be maintained for a long period of time also after printing operations to be performed subsequent to such flushing operation.

What is claimed is:

1. An ink jet recording apparatus, comprising:

a carriage shuttling across a width of a recording medium;

a recording head being mounted on said carriage and jetting ink droplets out of a nozzle opening;

an ink receiving means arranged in a nonprinting region, said ink receiving means for receiving ink droplets jetted during a periodic flushing operation performed at a predetermined cycle during a printing operation;

a cap member capable of sealing said recording head during at least one of a period of non-operation of said ink jet recording apparatus and a recovery operation;

a timer outputting a signal upon measurement of a predetermined time, which is longer than the predetermined cycle, during a period of operation of said ink jet recording apparatus measured from one of a point in time at which said recording head is released from said cap member after a print command has been outputted and a point in time at which said timer is reset and restarted; and a flushing control means controllable to move the recording head to the ink receiving means so that the recording head jets ink droplets, in response to the signal from the timer, and to reset the timer.

2. The ink jet recording apparatus of claim 1, wherein the flushing control means is controllable to move the recording head to the ink receiving means so that the recording head jets ink droplets, upon end of a series of printing operations based on a print command.

3. The ink jet recording apparatus of claim 1, wherein said flushing control means controls said recording head to jet a number of ink droplets in proportion to a time measured by said timer from one of a point in time at which said recording head is released from said cap member after a print command has been outputted and a point in time at which said timer is reset by said flushing control means.

4. The ink jet recording apparatus of claim 1, wherein the flushing control means controls a maximum number of ink droplets in the flushing operation based on a type of ink.

5. An ink jet recording apparatus comprising:

a carriage shuttling across a width of a recording medium;

a recording head being mounted on said carriage and jetting ink droplets out of a nozzle opening;

an ink receiving means arranged in a nonprinting region, said ink receiving means arranged to receive ink droplets jetted from said nozzle opening during a periodic flushing operation performed at a predetermined cycle during a cap releasing period in order to maintain ink jetting performance of the recording head during a printing operation;

a first timer outputting a signal upon measurement of a first predetermined time longer than the predetermined cycle during a period for which the recording head is released from a cap member after a print command has been outputted;

a second timer outputting a signal upon measurement of a predetermined time longer than said first predetermined time throughout a recording apparatus operation period; and a flushing control means controllable to move said recording head to said ink receiving means so that said recording head jets ink droplets, in response to a signal from one of said first timer and said second timer, and to reset said first timer and said second timer.

6. The ink jet recording apparatus of claim 5, wherein the number of ink droplets said flushing control means jets in response to a signal from said second timer is greater than a number of ink droplets said flushing control means jets in response to a signal from said first timer.

7. The ink jet recording apparatus of claim 5, wherein said first timer is reset and said second timer suspends measuring time upon an end of a first printing operation, wherein said first timer is reset upon the start of a subsequent printing operation, and wherein said second timer resumes measuring time upon a start of a subsequent printing operation.

8. An ink jet recording apparatus, comprising:

a carriage movably disposed to travel across a width of a recording medium;

a recording head mounted on said carriage, said recording head including a plurality of nozzles having nozzle openings, said nozzle openings being configured to allow passage of ink droplets;

at least one ink receiving means, said at least one ink receiving means being arranged in a nonprinting region, said ink receiving means arranged to receive ink droplets jetted from said nozzle openings;

a cap member capable of sealing said recording head;

a flushing control means, said flushing control means configured to move said recording head to said at least one ink receiving means and configured to jet a predetermined number of ink droplets out of said nozzles in response to each of a first output signal and a second output signal from a timing means; and a timing means, wherein said timing means generates a first output signal upon measurement of a first predetermined time from one of a point in time at which said recording head is released from said cap member and a point in time at which said timing means is reset by said flushing control means to restart said measurement of said first predetermined time, wherein said timing means generates a second output signal upon measurement of a second predetermined time, longer than said first predetermined time, at a periodic interval corresponding to said second predetermined time;

wherein said flushing control means resets said timing means to restart measurement of said first predetermined time after jetting said ink droplets in response to said first output signal.

9. The ink jet recording apparatus of claim 8, wherein said flushing control means is configured to move said recording head to said at least one ink receiving means to jet said ink droplets at an end of a series of printing operations based on a print command.

10. A method of flushing an ink-jet recording head according to claim 9, further comprising:

measuring a third predetermined time period, which is longer than said first predetermined time period, from a point in time at which said ink-jet recording head is released from said capping member upon receipt of said print signal;

resetting said third predetermined time period in conjunction with said resetting of said first predetermined time period upon measurement of a period of time corresponding to said first predetermined time period;

resetting said third predetermined time period upon measurement of a period of time corresponding to said third predetermined time period;

stopping measuring of said third predetermined time period upon termination of said printing operation;

resuming measuring of said third predetermined time period upon initiation of another printing operation;

generating a third signal upon measurement of a period of time corresponding to said third predetermined time period;

interrupting said another printing operation upon generation of said third signal;

positioning said ink-jet recording head in a non-printing region in response to said third signal;

jetting a predetermined quantity of ink droplets from nozzles in said recording head into an ink receiving member;

resetting said third predetermined time period; and resuming said another printing operation.

11. The ink jet recording apparatus of claim 8, wherein said flushing control means controls said recording head to jet a predetermined number of ink droplets proportional to a time measured by said timer from one of said point in tine at which said recording head is released from said cap member and a point in time at which said timing means is reset and restarted by said flushing control means.

12. The ink jet recording apparatus of claim 8, wherein said flushing control means jets a predefined maximum number of ink droplets based on a type of ink used by said recording head.

13. An ink jet recording apparatus according to claim 8, wherein said flushing control means is configured to jet a predetermined maximum number of ink droplets out of said nozzles in response to said first output signal and wherein said flushing control means is configured to jet a predetermined minimum number of ink droplets out of said nozzles in response to said second output signal.

14. An ink jet recording apparatus comprising:

a carriage movably disposed to travel across a width of a recording medium;

a recording head mounted on said carriage, said recording head including a plurality of nozzles having nozzle openings, said nozzle openings being configured to allow passage of ink droplets;

at least one ink receiving means, said at least on ink receiving means arranged in a nonprinting region, said ink receiving means arranged to receive ink droplets jetted from said nozzle openings;

a flushing control means, said flushing control means configured to move said recording head to said at least one ink receiving means and configured to jet a predetermined number of ink droplets out of said nozzles in response to each of a first output signal, a second output signal, and a third output signal;

a first timing means, said first timing means generating a first output signal upon measurement of a first predetermined time from one of a point in time at which said recording head is released from a cap member and a point in time at which said first timing means is reset and restarted by said flushing control means; and a second timing means, said second timing means generating a second output signal upon measurement of a second predetermined time longer than said first predetermined time, wherein said second predetermined time is measured cumulatively over a plurality of successive printing operations;

wherein one of said first timing means and said second timing means generates a third output signal upon measurement of a third predetermined time, longer than said first predetermined time, at a periodic interval corresponding to said third predetermined time;

wherein said flushing control means resets said first timing means and said second timing means to restart measurement of said first predetermined time and said second predetermined time after jetting said ink droplets in response to said first output signal.

15. The ink jet recording apparatus of claim 14, a number of ink droplets jets from said recording head in response to said second output signal is greater than a number of ink droplets jet from said recording head in response to said first output signal.

16. The ink jet recording apparatus of claim 14, said first timing means is reset and said second timing means suspends measuring said second predetermined time upon an end of a first printing operations, wherein said first timing means is reset upon the start of a subsequent printing operation, and wherein said second timing means resumes measuring said second predetermined time upon the start of a subsequent printing operation.

17. A method of flushing an ink-jet recording head, comprising:

initiating a printing operation upon receipt of a print signal;

uncapping said ink-jet recording head from a capping member in response to said print signal;

measuring a first predetermined time period from a point in time at which said ink-jet recording head is released from said capping member in response to said print signal and generating a first signal upon measurement of a period of time corresponding to said first predetermined time period;

measuring a second predetermined time period which is longer than said first predetermined time period and generating a second signal upon measurement of a period of time corresponding to said second predetermined time period;

interrupting said printing operation upon generation of at least one of said first and said second signal;

positioning said ink-jet recording head in a non-printing region;

jetting a predetermined quantity of ink droplets from nozzles in said recording head into an ink receiving member;

resetting said first predetermined time period; and resuming said printing operation.

18. An ink jet recording apparatus, comprising:

a moveable carriage disposed to traverse a width of a recording medium in at least one direction;

a recording head mounted on said carriage, said recording head configured to jet ink droplets out of at least one nozzle opening;

an ink receiver disposed in a nonprinting region, said ink receiver configured to receive said ink droplets jetted during a flushing operation that occurs during a printing operation;

a cap member configured to seal said recording head during at least one of a period of non-operation of said ink jet recording apparatus and a period of jetting said ink droplets from said recording head;

a timer outputting a first signal and a second signal, said first signal being output at a predetermined cycle during an individual printing operation, and said second signal being output upon measurement of a predetermined time, longer than said predetermined cycle, that lapses during consecutive printing operations; and a flushing controller that, in response to receiving one of said first signal and said second signal (1) initiates a flushing operation by moving said recording head to said ink receiver and causing said recording head to jet said ink droplets, and (2) resets said timer.

19. An ink jet recording apparatus of claim 18, wherein said flushing controller controls said recording head to jet a number of ink droplets in proportion to a time measured by said timer from one of a point in time at which said recording head is released from said cap member after a print command has been outputted and a point in time at which said timer is reset by said flushing controller.

* * * * *